US005953931A

United States Patent [19]

Brittain

[11] Patent Number: 5,953,931

[45] Date of Patent: Sep. 21, 1999

[54] PORTABLE UPRIGHT COOLER

[76] Inventor: Stephen G. Brittain, 17519 Patronella Ave., Torrance, Calif. 90504

[21] Appl. No.: 08/816,549

[22] Filed: Mar. 19, 1997

[51] Int. Cl.[6] ..... F25D 3/08

[52] U.S. Cl. ..... 62/272; 62/457.1; 62/457.2; 62/457.7; 220/377; 220/371; 312/236

[58] Field of Search ..... 62/272, 457.1, 62/457.2, 457.7; 220/377, 271; 312/236

[56] References Cited

U.S. PATENT DOCUMENTS 4,084,866 4/1978 Hayashi ..... 312/138

5,295,365 3/1994 Redford ..... 62/265

5,605,056 2/1997 Brown et al. ..... 62/457.4

*Primary Examiner*—Henry Bennett

*Assistant Examiner*—Mark Sen

[57] ABSTRACT

A new Portable Upright Cooler for keeping food and drinks cool. The inventive device includes a container member defining an enclosed volume, handles secured to the container, and adjustable support feet for supporting the cooler in an upright position. A drip tray is disposed within the volume for collecting dripping liquids. The tray is configured to prevent the liquids therein from splashing out of the tray. The walls of the cooler are adapted to guide dripping liquids into the drip pan.

17 Claims, 4 Drawing Sheets

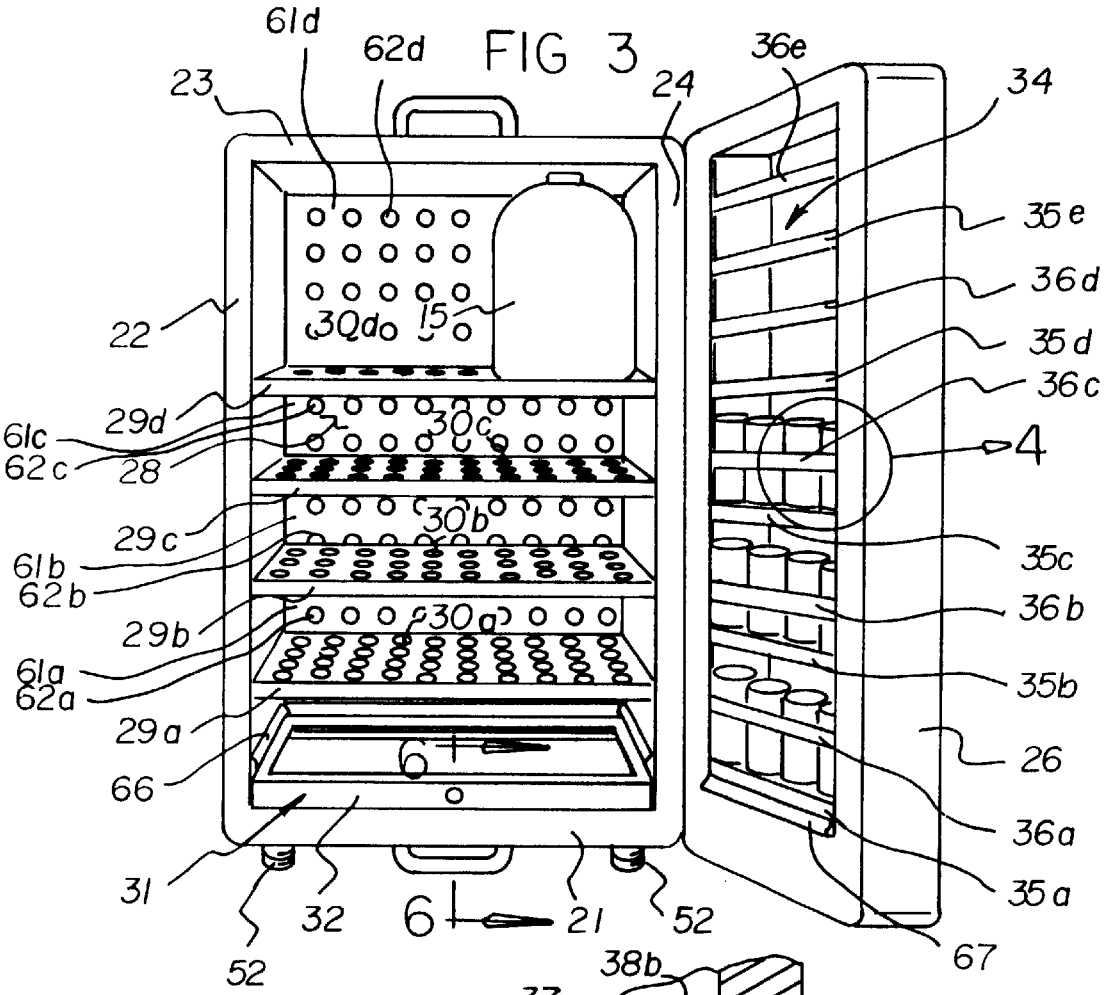
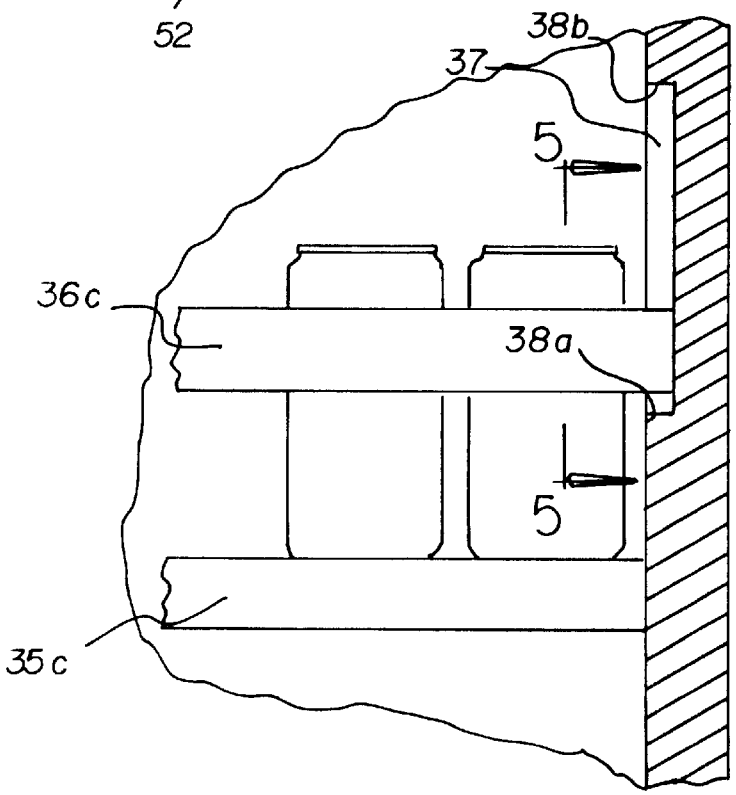
FIG 4

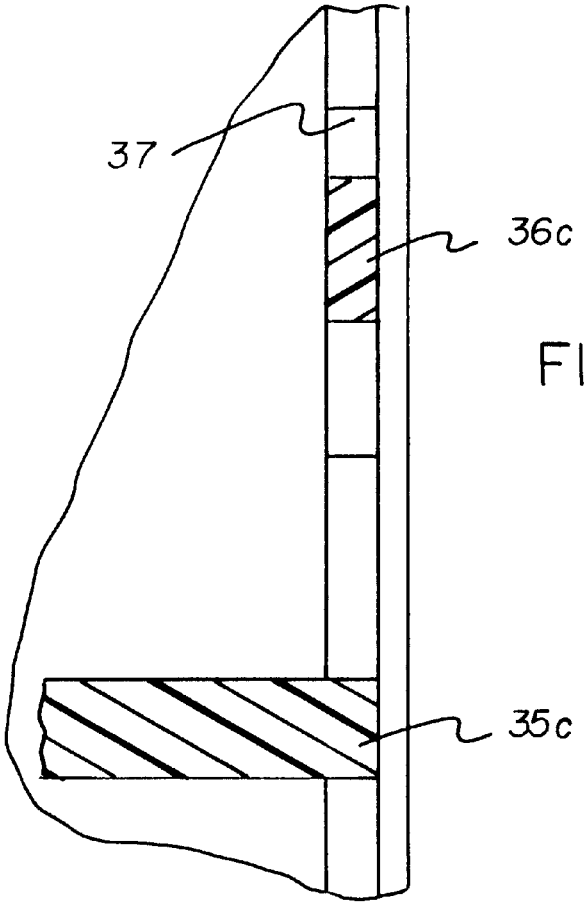
FIG 5
FIG 6
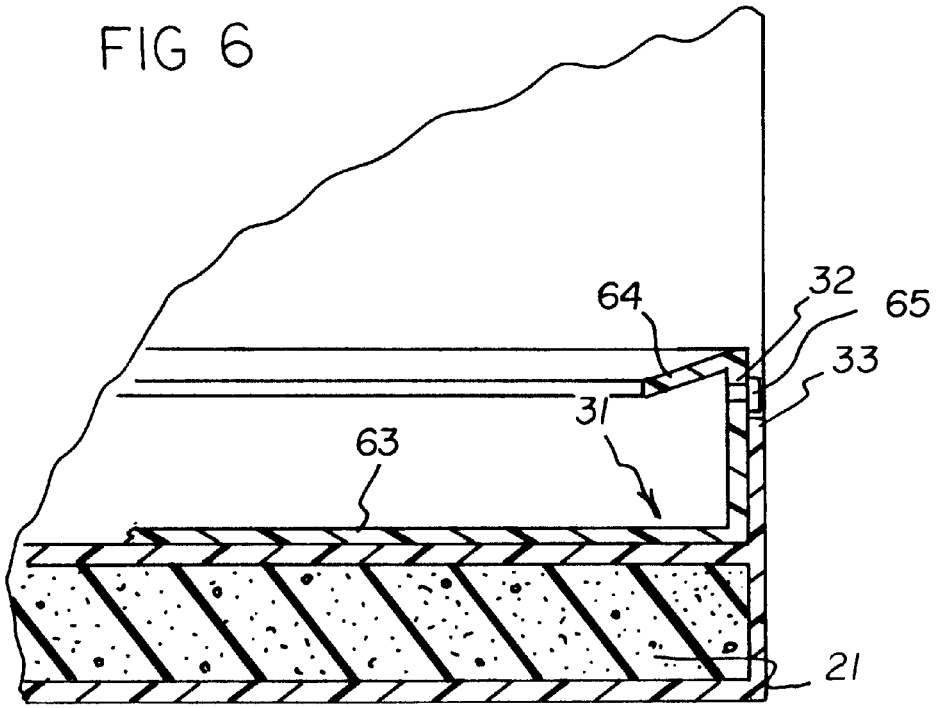

PORTABLE UPRIGHT COOLER

BACKGROUND OF THE INVENTION

1. Field of the Invention

The present invention relates to coolers and more particularly pertains to a new Portable Upright Cooler for keeping food and drinks cool.

2. Description of the Prior Art

The use of coolers is known in the prior art. More specifically, coolers heretofore devised and utilized are known to consist basically of familiar, expected and obvious structural configurations, notwithstanding the myriad of designs encompassed by the crowded prior art which have been developed for the fulfillment of countless objectives and requirements.

Known prior art coolers include U.S. Pat. No. 5,184,477; U.S. Pat. No. 5,329,787; U.S. Pat. No. Des. 347,971; U.S. Pat. No. 5,330,261; U.S. Pat. No. 4,724,681 and U.S. Pat. No. 4,505,132.

While these devices fulfill their respective, particular objectives and requirements, the aforementioned patents do not disclose a new Portable Upright Cooler. The inventive device includes a container member defining an enclosed volume, handles secured to the container member, and support feet for supporting the cooler in an upright position.

In these respects, the Portable Upright Cooler according to the present invention substantially departs from the conventional concepts and designs of the prior art, and in so doing provides an apparatus primarily developed for the purpose of keeping food and drinks cool.

SUMMARY OF THE INVENTION

In view of the foregoing disadvantages inherent in the known types of coolers now present in the prior art, the present invention provides a new Portable Upright Cooler construction wherein the same can be utilized for keeping food and drinks cool.

The general purpose of the present invention, which will be described subsequently in greater detail, is to provide a new Portable Upright Cooler apparatus and method which has many of the advantages of the coolers mentioned heretofore and many novel features that result in a new Portable Upright Cooler which is not anticipated, rendered obvious, suggested, or even implied by any of the prior art coolers, either alone or in any combination thereof.

To attain this, the present invention generally comprises a container member defining an enclosed volume, handles secured to the container member, and support feet for supporting the cooler in an upright position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Upright Cooler apparatus and method which has many of the advantages of the coolers mentioned heretofore and many novel features that result in a new Portable Upright Cooler which is not anticipated, rendered obvious, suggested, or even implied by any of the prior art coolers, either alone or in any combination thereof.

It is another object of the present invention to provide a new Portable Upright Cooler which may be easily and efficiently manufactured and marketed.

It is a further object of the present invention to provide a new Portable Upright Cooler which is of a durable and reliable construction.

An even further object of the present invention is to provide a new Portable Upright Cooler which is susceptible of a low cost of manufacture with regard to both materials and labor, and which accordingly is then susceptible of low prices of sale to the consuming public, thereby making such Portable Upright Cooler economically available to the buying public.

Still yet another object of the present invention is to provide a new Portable Upright Cooler which provides in the apparatuses and methods of the prior art some of the advantages thereof, while simultaneously overcoming some of the disadvantages normally associated therewith.

Still another object of the present invention is to provide a new Portable Upright Cooler for keeping food and drinks cool.

Yet another object of the present invention is to provide a new Portable Upright Cooler which includes a container member defining an enclosed volume, handles secured to the container, and support feet for supporting the cooler in an upright position.

Still yet another object of the present invention is to provide a new Portable Upright Cooler that can operate as an upright or a chest, and which cools and protects food and drinks more efficiently.

Even still another object of the present invention is to provide a new Portable Upright Cooler that separates food and drinks more efficiently, thus providing easy access to, and preventing damage of, items within the cooler These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the cooler with the lid opened.

FIG. 4 is an exploded view of the lid contained within the circled line 4 in FIG. 3.

FIG. 5 is a cross sectional view taken along line 5—5 of FIG. 4.

FIG. 6 is a cross sectional view taken along line 6—6 of FIG. 3.

DESCRIPTION OF THE PREFERRED EMBODIMENT

Figure 1:
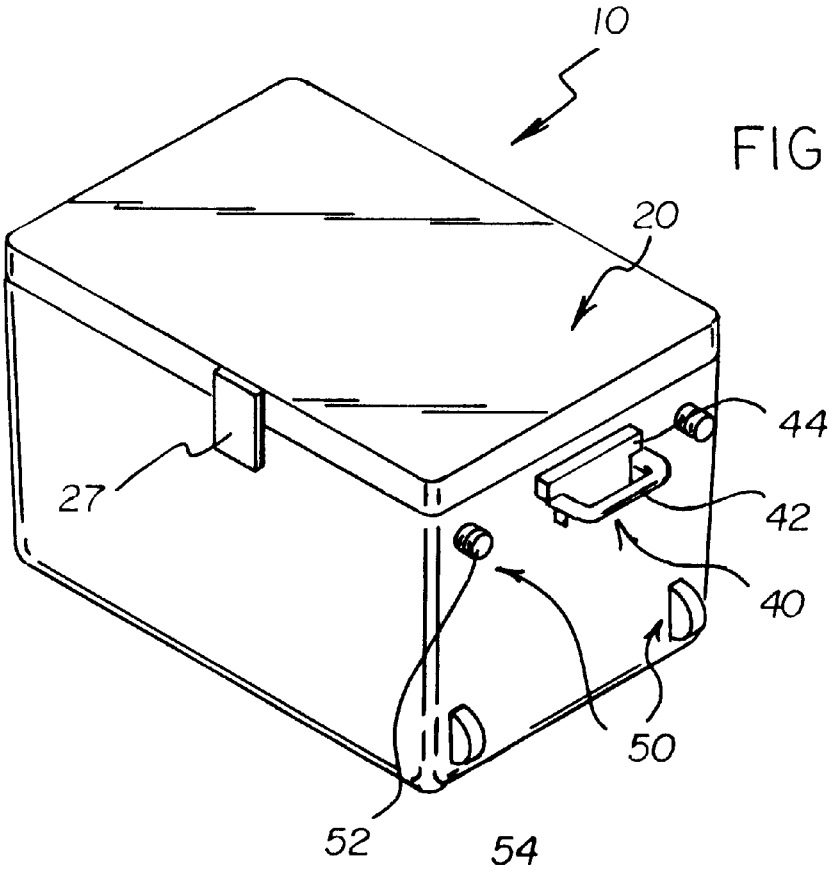
FIG. 1 is a perspective view of a new Portable Upright Cooler according to the present invention in the transport position.
Figure 2:
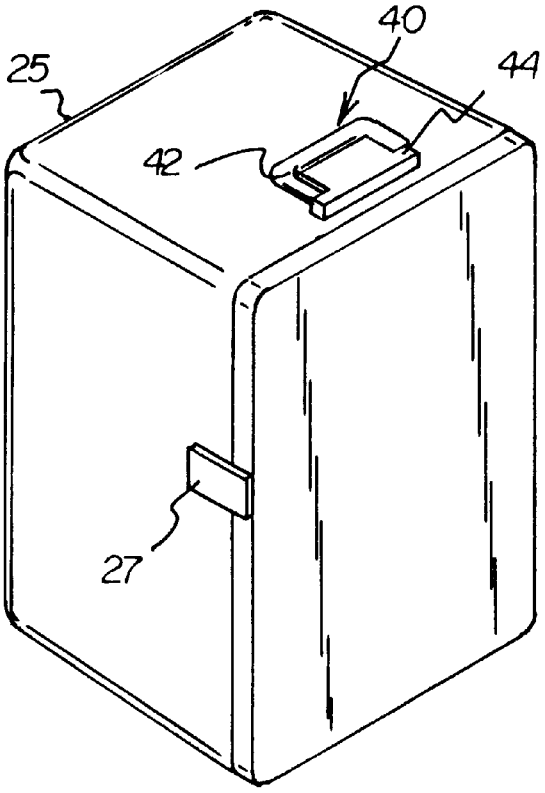
FIG. 2 is a view of the cooler in the upright position.
Figure 7:
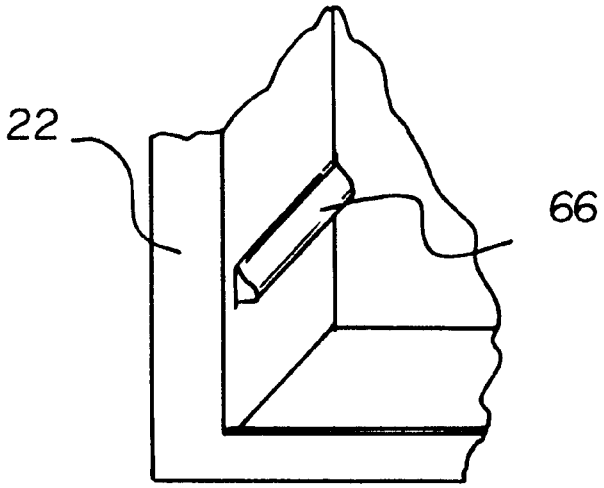
FIG. 7 is a perspective view of the lip on one of the side walls for guiding liquid into the drip pan.

With reference now to the drawings, and in particular to FIGS. 1 through 9 thereof, a new Portable Upright Cooler embodying the principles and concepts of the present invention and generally designated by the reference numeral 10 will be described.

More specifically, it will be noted that the Portable Upright Cooler 10 comprises a container member 20, handle means 40 for carrying the cooler, and support means 50 for supporting the cooler in the upright position, similar to a refrigerator.

As best illustrated in FIGS. 1 through 9, it can be shown that the container member 20 includes side walls 21–24, a bottom wall 25, and a lid member 26 defining an enclosed volume 28. The lid member is pivotally attached to the side wall 24 in a manner which would be apparent to one having ordinary skill in the art. The container member is formed from metal or plastic materials with suitable insulation, similar to standard chest type coolers. A locking member 27 is attached to the lid member 26 for keeping the lid closed, but permitting the lid to be opened.

Figure 9:
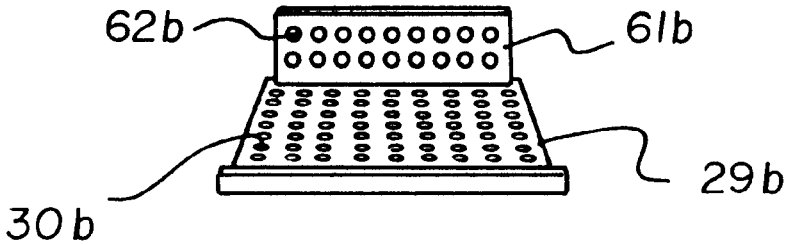
FIG. 9 is a front perspective view of one of the shelf members.

As shown in FIG. 3, a plurality of shelf means are disposed within the enclosed volume 28 to divide the volume into a series of distinct chambers to hold different food items. As best shown in FIG. 9, each shelf means comprises a planar shelf portion 29*a–d* respectively, and a back wall 61*a–d* extending upward from a respective shelf portion. The shelf portions 29*a–d* are generally planar, and are disposed parallel to the side walls 21,23. The shelf means are suitably attached to the side walls 22,24 such that they are removable, and have a height slightly less than the height of the side walls 22,24 extending from the bottom wall 25, such that the back walls 61*a–d* are slightly spaced from the bottom wall 25. The shelf portions 29*a–d* include a plurality of apertures 30*a–d* therethrough, allowing cold air to communicate between the distinct chambers. The back walls 61*a–d* also include apertures 62*a–d* therethrough, which facilitate cold air circulation and permit liquid to drip therethrough and onto the bottom wall 25. A container 15 of frozen water can be placed within one of the chambers to provide cooling for the cooler. A block of ice, or other suitable cooling devices, could be used in place of the container 15.

Figure 8:
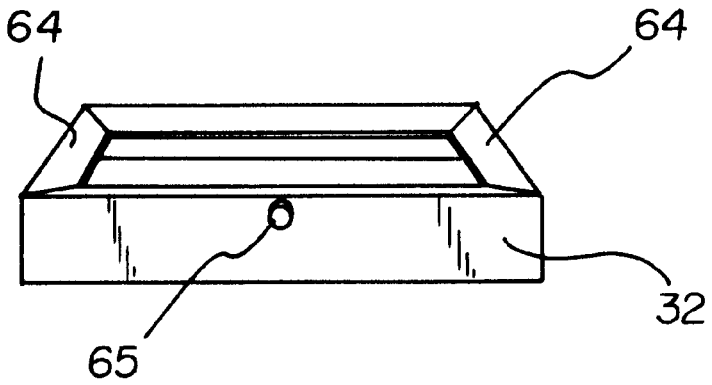
FIG. 8 is a front perspective view of the drip pan.

A drip tray 31 is removably supported within the enclosed volume by the side wall 21. The tray is disposed so as to collect liquid which drips from objects within the cooler while the cooler is in the upright position. The tray 31 includes four side walls 32 extending upward from a bottom wall 63 to define an interior volume. As shown in FIG. 6, the side wall 21 includes a projecting lip 33 which extends for a distance along one side wall 32 of the tray 31. The lip 33 prevents leakage of liquid from the container member which is not collected by the drip tray 31 or which spills from the tray. The tray 31 can be removed by lifting the tray above the lip and then removing from the cooler. As best illustrated in FIGS. 6 and 8, the side walls 32 of the drip tray have inward extending lips 64 angled toward the bottom wall 63. The lips 64 help retain liquid within the drip tray when the cooler is being transported. A drain plug 65 in one of the side walls 32, such as the side wall 32 adjacent the lip 33, permits draining of liquid from the drip tray.

Lips 66 are formed on the side walls 22,24 and bottom wall 25 in a location just above the drip tray when the tray is inserted into the cooler, such that liquid which drips onto on the side walls 22,24 and bottom wall 25, and flows downward when the cooler is upright, is directed by the lips 66 to flow into the drip tray. The lips 66 comprise projections integrally formed with the walls and extending therefrom an extent sufficient to ensure that liquid is directed into the drip tray.

The lid member 26 is sufficiently thick to include a hollowed interior space 34. The thickness of the lid, and therefore the depth of space 34, should be sufficient to accommodate beverages, such as twelve ounce cans and bottles, and various condiments, such as ketchup and mustard. The space 34 is divided by a plurality of shelves 35*a–e* into different levels. A restraining member 36*a–e* is also associated with each shelf 35*a–e* to cooperate with the shelf in retaining items on the shelf when the cooler is upright, and to retain items in the space 34 when the cooler is being transported. The members 36*a–e* have two opposite ends disposed within slots 37 (only one slot is shown, the other slot is similar to the shown slot). The slots 37 have a limited length which allow the members 36*a–e* to move up and down a certain distance, to facilitate removal and insertion of items onto the shelves. Movement of the members is limited by shoulders 38*a,b* at the ends of the slots. The members 36*a–e* are slightly flexible, so that when one end of a member is moved downward in its slot and the other end is moved upward in its slot, the member can be removed with a slight bending of the member. However, the members 36*a–e* should be sufficiently stiff to hold items on the shelves during transport.

The lid member 26 also includes a lip 67 integrally attached thereto just below the shelf 35*a*. The lip 67 is similar to the lips 66 and performs a similar function thereto, so no further explanation of lip 67 is necessary.

To facilitate carrying of the cooler during transport, the side walls 21,23 have handle means 40 attached thereto. Each handle means includes a U-shaped handle 42 which is pivotally attached in a conventional manner to a handle support member 44 secured to the respective side wall.

Additionally, in order to facilitate transport of the cooler, and to support the cooler when it is upright, support means 50 are disposed on the side wall 21. The support means includes a pair of support feet 52 attached to the side wall 21 by being threaded into the side wall 21. Therefore the support feet 52 can be screwed in and out relative to the side wall for leveling the cooler when it is located on uneven ground. Note that the support feet should extend from the wall 21 a distance greater than the distance the handle 42 extends from the wall, so that the handle does not interfere with the support function of the feet 52. The feet can be made of any suitable rigid material that supports the weight of the cooler and is long lasting, such as metals, plastics, and hard rubbers. The support means 50 also includes wheels 54 attached to the side wall 21 adjacent the bottom wall 25. The wheels 54 are slightly recessed into the side wall 21 such that they do not interfere with the support function of the feet 52 when the cooler is upright, but which permit rolling transport of the cooler. The user merely grabs the opposite handle 42 and pulls the cooler along the ground, facilitated by the wheels 54. The wheels also support the side wall 21 off of the ground when the cooler is upright.

In use, during transportation, the cooler is either carried by its handles so that the bottom wall 25 is substantially parallel to the ground, or it is pulled by the handle 42 along the ground, supported by the wheels. In this position, the items on the shelves 35*a–e* are held in place by the restraining members 36*a–e*. In use, the cooler is tilted upright so that it rests on the support legs 52, and it then operastandard re to a standard refrigerator.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Portable Cooler assembly having a substantially horizontal transport position and an upright in-use position, comprising:

a container member including first and second pairs of oppositely disposed side walls, a bottom wall, and a lid member pivotally attached to one of said side walls of said first pair, said pairs of side walls, said bottom wall and said lid member defining an enclosed volume;

a drip pan inside the enclosed volume and supported by said one side wall of said second pair, in order to collect drips from objects inside the enclosed volume when the cooler assembly is in the upright position;

handle means secured on each side wall of said second pair, for facilitating carrying of the cooler assembly in the transport position; and support means disposed on one of said side walls of said second pair, for supporting the cooler assembly in the upright position.

2. The Portable Cooler assembly of claim 1, wherein the support means comprises a plurality of support feet attached to said one side wall of said second pair.

3. The Portable Cooler assembly of claim 2, wherein the plurality of support feet are attached by threaded means to said one side wall of said second pair permitting the support feet to be screwed into, and out of, said one side wall of said second pair.

4. The Portable Cooler assembly of claim 1, wherein each handle means comprises a pivoting U-shaped handle.

5. The Portable Cooler assembly of claim 1, wherein the container member includes a plurality of shelf means dividing the enclosed volume into a plurality of distinct chambers.

6. The Portable Cooler assembly of claim 5, wherein the shelf means comprise spaced, planar shelf members disposed parallel to the side walls of said second pair.

7. The Portable Cooler assembly of claim 6, wherein each shelf member includes a plurality of apertures therein, to allow communication between the distinct chambers.

8. The Portable Cooler assembly of claim 6, further comprising an apertured back wall extending upward from each shelf member, said back wall being spaced from said bottom wall.

9. The Portable Cooler assembly of claim 1, wherein the drip pan includes a side wall adjacent the lid member and extending parallel to the bottom wall, and said one side wall of said second pair includes a projecting lip extending along a portion of said pan side wall, such that in the upright position the drip pan must be lifted upward over the lip in order to remove the drip pan from the enclosed volume.

10. The Portable Cooler assembly of claim 1, wherein the drip pan includes a plurality of side walls and a bottom wall defining an interior volume, and lips extending from the drip pan side walls in a direction towards the drip pan bottom wall and the drip pan interior volume.

11. The Portable Cooler assembly of claim 10, further comprising drain means associated with one of said drip pan side walls for selectively draining fluid from the drip pan.

12. The Portable Cooler assembly of claim 1, wherein said first pair of side walls, said bottom wall, and said lid member include guide means attached thereto adjacent the drip pan for guiding liquid into the drip pan.

13. The Portable Cooler assembly of claim 1, wherein the lid member includes a hollowed interior space with a plurality of shelf members spaced along the interior space.

14. The Portable Cooler assembly of claim 13, wherein each shelf member includes a removable restraining member associated therewith to secure objects on said shelf members and within said interior space.

15. The Portable Cooler assembly of claim 14, wherein each restraining member includes two oppositely disposed ends, each end being disposed within a groove formed in the lid member.

16. A Portable Cooler assembly having a substantially horizontal transport position and an upright in-use position, comprising:

a container member including first and second pairs of oppositely disposed side walls, a bottom wall, and a lid member pivotally attached to one of said side walls of said first pair, said pairs of side walls, said bottom wall and said lid member defining an enclosed volume;

the lid member including a hollowed interior space with a plurality of shelf members spaced along the interior space, each shelf member including a removable restraining member associated therewith to secure objects on said shelf members and within said interior space;

handle means secured on each side wall of said second pair, for facilitating carrying of the cooler assembly in the transport position; and support means disposed on one of said side walls of said second pair, for supporting the cooler assembly in the upright position.

17. The Portable Cooler assembly of claim 16, wherein each restraining member includes two oppositely disposed ends, each end being disposed within a groove formed in the lid member.

* * * * *